US007204745B2

(12) United States Patent
Thysell

(10) Patent No.: US 7,204,745 B2
(45) Date of Patent: Apr. 17, 2007

(54) DEVICE IN A CIRCULAR, DISK-SHAPED ELEMENT INTENDED FOR CLEANING PURPOSES

(75) Inventor: Håkan Thysell, Söderköping (SE)

(73) Assignee: HTC Sweden AB, Soderkoping (SE)

( * ) Notice: Subject to any disclaimer, the term of this patent is extended or adjusted under 35 U.S.C. 154(b) by 27 days.

(21) Appl. No.: 10/506,026

(22) PCT Filed: Feb. 26, 2003

(86) PCT No.: PCT/SE03/00310

§ 371 (c)(1),
(2), (4) Date: Apr. 26, 2005

(87) PCT Pub. No.: WO03/075734

PCT Pub. Date: Sep. 18, 2003

(65) Prior Publication Data

US 2005/0172428 A1 Aug. 11, 2005

(30) Foreign Application Priority Data

Mar. 13, 2002 (SE) ..... 0200754

(51) Int. Cl.
*B24D 11/00* (2006.01)

(52) U.S. Cl. ..... 451/526; 451/344; 451/350; 451/353; 451/357; 451/359; 451/527; 451/529

(58) Field of Classification Search ..... 451/344, 451/350, 353, 357, 359, 526, 527, 529
See application file for complete search history.

(56) References Cited

U.S. PATENT DOCUMENTS

| | | | | |
|---|---|---|---|---|
| 5,054,245 | A * | 10/1991 | Coty | 451/353 |
| 5,432,970 | A * | 7/1995 | Reid | 15/49.1 |
| 5,605,493 | A | 2/1997 | Donatelli et al. | |
| 5,890,954 | A * | 4/1999 | Barous | 451/350 |
| 5,954,569 | A * | 9/1999 | Hutchison et al. | 451/63 |
| 6,234,886 | B1 | 5/2001 | Rivard et al. | |
| 6,840,842 | B2 * | 1/2005 | Hirai et al. | 451/28 |
| 6,884,150 | B2 * | 4/2005 | Barbour | 451/8 |

* cited by examiner

*Primary Examiner*—Joseph J. Hail, III
*Assistant Examiner*—Shantese McDonald
(74) *Attorney, Agent, or Firm*—Harness, Dickey & Pierce, P.L.C.

(57) ABSTRACT

The invention relates to a device in a circular disk-shaped cleaning element intended for cleaning by means of a cleaning machine. The element is designed with a number of recesses (3) distributed over the active cleaning surface (2*a*) thereof Grinding elements (4) containing industrial diamonds and conventionally used for grinding stone and concrete floors are arranged in the said recesses. The grinding elements are fixed in such a way that in use they only come into light contact with the surface that is to be cleaned. The invention further relates to the use of a cleaning element in connection with wet cleaning conventionally performed with a cleaning machine. Alternatively the device may be used in such a way that dry polishing is first performed using the cleaning element, following which wet cleaning is carried out using a conventional cleaning element.

10 Claims, 4 Drawing Sheets

DEVICE IN A CIRCULAR, DISK-SHAPED ELEMENT INTENDED FOR CLEANING PURPOSES

Figure 1A:
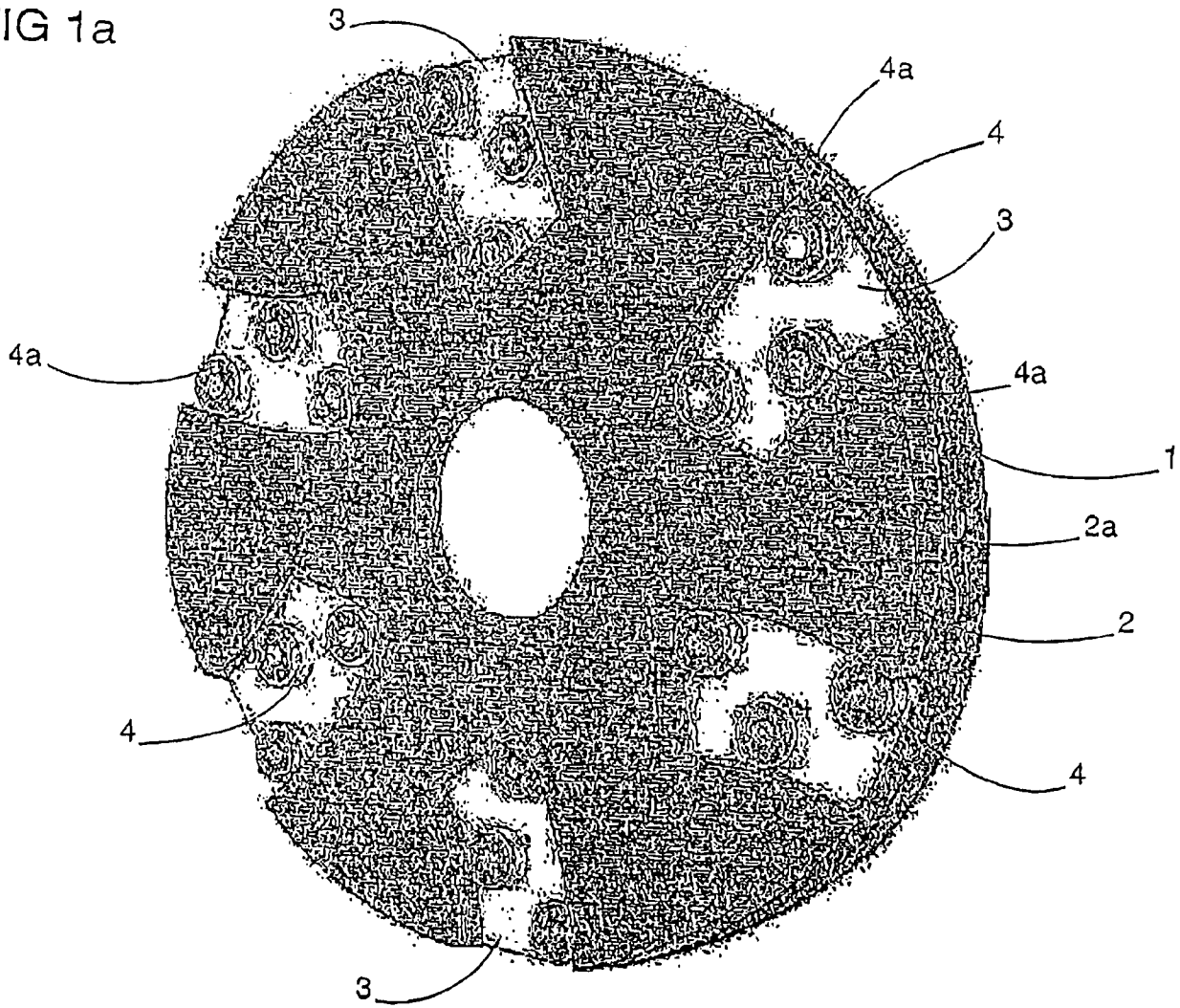

The present invention relates to a device according to the pre-characterizing clause of claim 1.

In professional floor cleaning, for example in department stores, cleaning machines are used in attempts to remove dirt mechanically, often with the addition of chemicals. As the floors become ever more worn that is to say scored and cracked and, particularly in the vicinity of dairy and meat counters, exposed to chemical wear, the cleaning results increasingly deteriorate, and attempts have been made to remedy this with ever greater quantities of more powerfully acting chemicals. It might be said that, in this way, cleaning ends up in vicious circle.

Although it is true that this vicious circle can be broken by grinding the floor, thereby removing the scores and cracks in which dirt collects, such grinding requires special machines, takes a relatively long time to carry out and is also relatively costly.

U.S. Pat. Nos. 5,054,245 A, 5,605,493 A and 6,234,886 B1 are cited as examples of the prior art. These published patents relate to devices of the type specified in the pre-characterising clause of claim 1, and mole specifically to cleaning machines in which, in order to achieve a better cleaning result, the ordinary cleaning elements of the machine are combined with grinding elements containing grinding material such as diamond for grinding stone floors, for example.

The object of the present invention is to provide a device of the aforementioned type, by means of which cleaning can be rendered more efficient and the time interval between two grinding operations can be considerably extended. This is achieved in that the invention has the features specified in the characterising part of claim 1.

The sub-ordinate claims 2–3 specify advantageous embodiments of the invention.

The invention also relates to the use of a cleaning element according to the invention as set forth in claim 4.

The invention will be explained in more detail below with reference to the drawing attached, in which FIG. 1*a*, in a perspective view shows, by way of example, a cleaning element with a nylon scouring surface according to the invention.

Figure 1B:
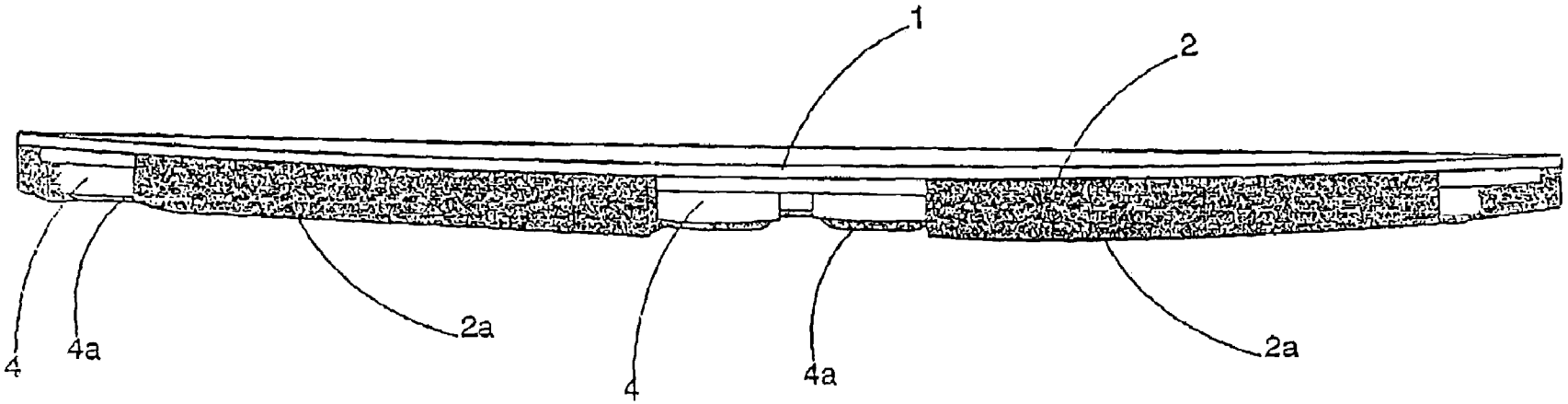

FIG. 1*b* shows a cross-section through the cleaning element in FIG. 1*a*.

FIG. 2*a* in a perspective view shows another example of an embodiment with a brush surface and in which grinding elements are arranged in a different pattern to that in FIG. 1*a*.

Figure 3:
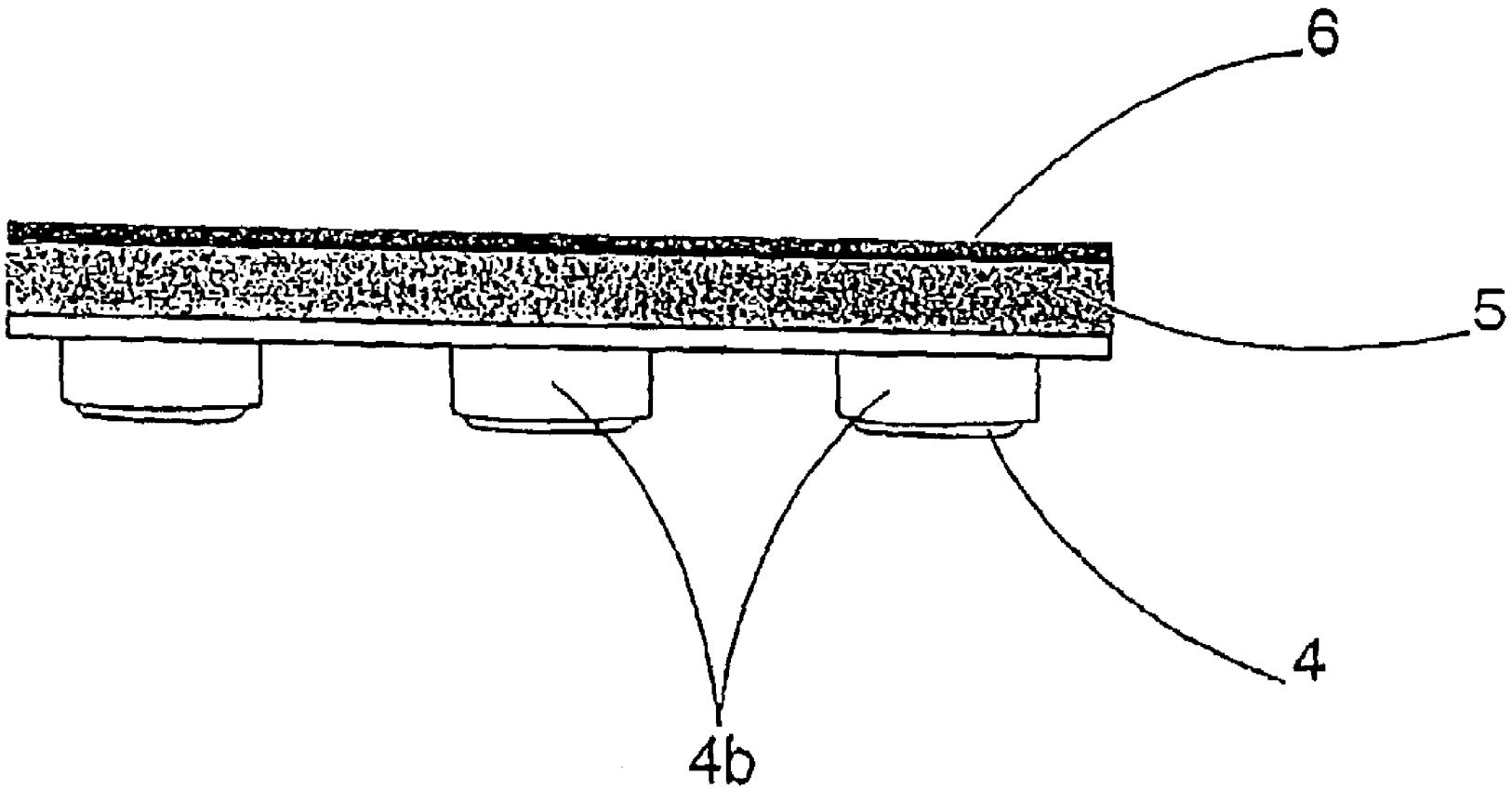

FIG. 3 shows a cross-section through a grinding element in a spring-mounted thermoplastic holder.

Fitted to a cleaning machine of conventional type, a circular, disk-shaped cleaning element according to the invention is intended to improve the cleaning result and to this end comprises a rigid bottom disk 1, which is slightly convex. Fixed to the bottom disk 1 is a disk 2 made from a material which from experience gives a good cleaning result. Such a material is, for example, so-called nylon scouring material. In the disk 2 are a number of recesses 3 distributed over the active cleaning surface 2*a* thereof. Grinding elements 4 are arranged in the said recesses in such a way that, in the cleaning operation, these only come into light contact with the surface that is to be cleaned. The grinding elements 4, which are arranged in various patterns, and at the corners of a triangle in the embodiment shown in FIG. 1*a*, are of the usual type used in grinding stone or concrete floors and contain industrial diamonds. The requirement that the grinding element should only come into light contact with the surface that is to be cleaned is met in that when the disk 2 is compressed in use the active surface 4*a* of the elements lies directly under the active surface 2*a* of the disk 2.

As shown in FIG. 3, each grinding element 4 is enclosed in a thermoplastic holder 4*b* and the holder is in turn spring-mounted on the bottom disk 1 of the cleaning element. The springing preferably consists of a siliconc spring disk 5 and is fixed to the bottom disk 1 by means of a Velcro element 6.

Figure 2:
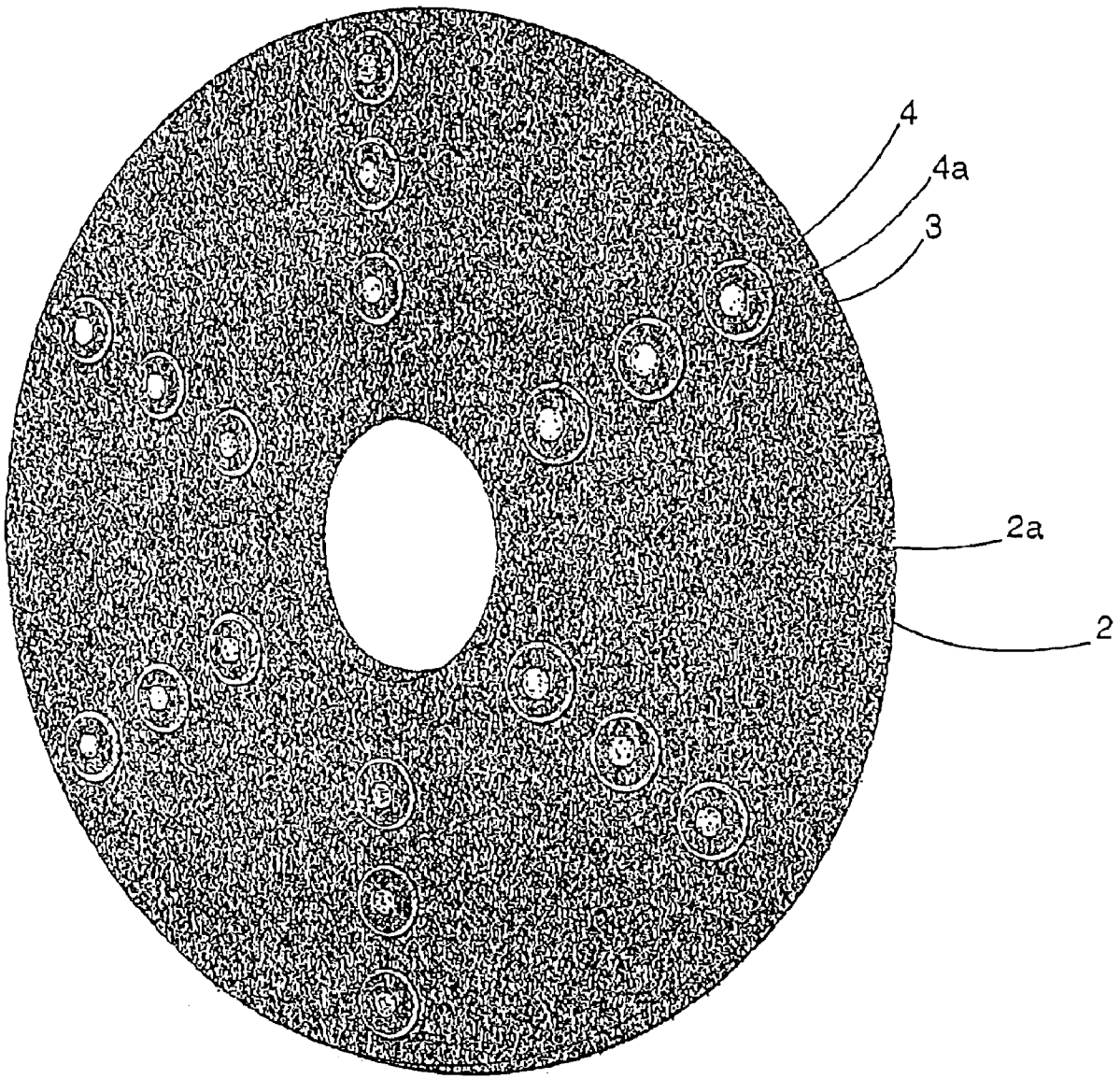

As will be apparent from another particular characteristic of the invention and as is shown in FIG. 2, the cleaning element is designed with a bush surface, that is to say the disk 2 is of a bush-like material. It will be appreciated that the disk 2 may naturally be designed with a combination of nylon scouring material and brush-like material. In the embodiment shown in FIG. 2 the grinding elements are located in radial rows, a recess being provided for each grinding element.

The device may alternatively be used in such a way that dry polishing is first performed using the cleaning element according to the invention, following which wet cleaning is carried out using a conventional cleaning element such as a nylon scouring disk.

The invention claimed is:

1. A disk-shaped cleaning element intended for cleaning and used on a cleaning machine, comprising:

a bottom disk, the disk having a plurality of recesses distributed over an active cleaning surface of the disk;

grinding elements, containing industrial diamonds which are used for grinding stone and concrete floors, arranged in the plurality of recesses; and a thermoplastic holder enclosing each grinding element, wherein the recesses are dimensioned such that the grinding elements only come into contact with a surface to be cleaned when the disk is compressed, and the grinding elements are brought into light contact with the surface that is to be cleaned when the disk is compressed by pressing the active cleaning surface against the surface to be cleaned, and the thermoplastic holder is spring-mounted on the disk.

2. The disk-shaped cleaning element according to claim 1, wherein the cleaning element comprises a scouring disk.

3. The disk-shaped cleaning element according to claim 2, wherein the scouring disk is made from nylon.

4. The disk-shaped cleaning element according to claim 1, wherein the cleaning element is designed with a brush surface.

5. The disk-shaped cleaning element according to claim 1, wherein the cleaning element comprises both a scouring disk and a brush surface.

6. The disk-shaped cleaning element according to claim 1, further comprising a spring disk for spring-mounting the thermoplastic holder.

7. The disk-shaped cleaning element according to claim 6, wherein spring disk is a silicone spring disk.

8. The disk-shaped cleaning element according to claim 6, wherein the spring disk is attached to the disk by fasteners.

9. The disk-shaped cleaning element according to claim 8, wherein the fasteners are Velcro.

10. A method for cleaning and used on a cleaning machine, comprising:

dry polishing using a disk-shaped cleaning element, the disk-shaped cleaning element includes:

a bottom disk, the disk having a plurality of recesses distributed over an active cleaning surface of the disk;

grinding elements, containing industrial diamonds which are used for grinding stone and concrete floors, arranged in the plurality of recesses; and a thermoplastic holder enclosing each grinding element, wherein the active cleaning surface is brought into contact with a surface that is to be cleaned, and the grinding elements are brought into light contact with the surface that is to be cleaned when the disk is compressed, and the thermoplastic holder is spring-mounted on the disk; and wet cleaning using a cleaning element.

* * * * *